US010973278B2

(12) United States Patent
Raia

(10) Patent No.: US 10,973,278 B2
(45) Date of Patent: Apr. 13, 2021

(54) SELF-FASTENING INDOOR PROTECTING DEVICE

(71) Applicants: Sorin Raia, Bucharest (RO); Behboud Madadi, Burcharest (RO)

(72) Inventor: Sorin Raia, Bucharest (RO)

( * ) Notice: Subject to any disclaimer, the term of this patent is extended or adjusted under 35 U.S.C. 154(b) by 0 days.

(21) Appl. No.: 16/093,528

(22) PCT Filed: Apr. 25, 2017

(86) PCT No.: PCT/RO2017/000006

§ 371 (c)(1),
(2) Date: Oct. 12, 2018

(87) PCT Pub. No.: WO2017/188833

PCT Pub. Date: Nov. 2, 2017

(65) Prior Publication Data

US 2019/0208855 A1 Jul. 11, 2019

(30) Foreign Application Priority Data

Apr. 26, 2016 (RO) ..... a 2016 00300

(51) Int. Cl.
*A43B 13/20* (2006.01)
*A43C 11/00* (2006.01)
(Continued)

(52) U.S. Cl.
CPC ..... *A43B 3/18* (2013.01); *A43B 3/163* (2013.01); *A43B 11/00* (2013.01); *A43B 13/20* (2013.01);
(Continued)

(58) Field of Classification Search
CPC ..... A43B 13/20; A43B 13/203; A43B 13/206; A43B 11/00; A43B 2/18; A43B 2/163;
(Continued)

(56) References Cited

U.S. PATENT DOCUMENTS 4,924,605 A * 5/1990 Spademan ..... A43B 5/00 36/114
5,113,599 A 5/1992 Cohen et al.
(Continued)

FOREIGN PATENT DOCUMENTS

CN 2870521 Y 2/2007
FR 2627960 A1 9/1989

OTHER PUBLICATIONS

European Patent Office, International Search Report and Written Opinion dated Aug. 28, 2017 for PCT International Application No. PCT/R02017/000006, international filing date Apr. 25, 2017, priority date Apr. 26, 2016.

*Primary Examiner* — Ted Kavanaugh
(74) *Attorney, Agent, or Firm* — Law Office of Andrei D Popovici, PC

(57) ABSTRACT

The invention relates to gum shoe-type footwear and a mechanism both for fixing the shoes and for fastening normal footwear provided with this mechanism which allows a person to perform this operation without leaning and without using their hands. According to the invention, the device comprises a Subassembly (A) drive mechanism and a Subassembly (B) of lower fastening of the Subassembly (A), a Subassembly (C) of upper fastening of the Subassembly (A) and footwear positioning and a pneumatic Subassembly (D).

2 Claims, 9 Drawing Sheets

Figure 7:
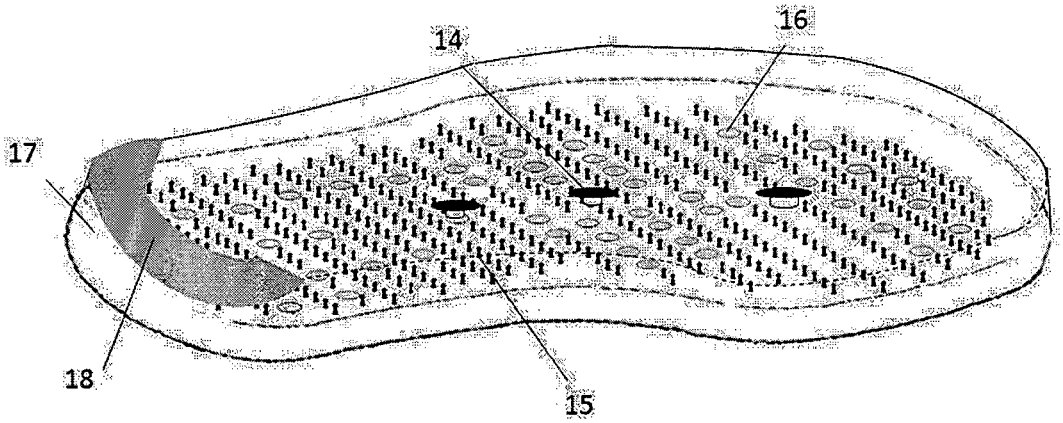

(51) Int. Cl.

| | |
|---|---|
| ***A43B 3/18*** | (2006.01) |
| ***A43B 3/16*** | (2006.01) |
| ***A43B 11/00*** | (2006.01) |
| ***A43C 11/14*** | (2006.01) |
| ***A43C 11/20*** | (2006.01) |

(52) U.S. Cl.
CPC ..... *A43B 13/203* (2013.01); *A43B 13/206* (2013.01); *A43C 11/00* (2013.01); *A43C 11/008* (2013.01); *A43C 11/14* (2013.01); *A43C 11/20* (2013.01)

(58) Field of Classification Search
CPC ..... A43C 11/00; A43C 11/008; A43C 11/20; A43C 11/14
USPC ..... 36/138, 29, 88, 93
See application file for complete search history.

(56) References Cited

U.S. PATENT DOCUMENTS 5,839,210 A * 11/1998 Bernier ..... A43B 1/0072 36/50.1
5,983,530 A * 11/1999 Chou ..... A43C 1/04 36/118.1
6,014,823 A * 1/2000 Lakic ..... A41D 19/01523 36/11.5
6,032,387 A * 3/2000 Johnson ..... A43C 1/06 36/118.1
6,378,230 B1 4/2002 Rotem et al.
7,059,069 B2 6/2006 Raluy et al.
7,107,706 B1 * 9/2006 Bailey, Sr. ..... A43B 3/0005 36/29
7,451,555 B1 * 11/2008 Lakic ..... A43B 7/141 36/29
8,522,456 B2 9/2013 Beers et al.
2003/0009917 A1 * 1/2003 Voswinkel ..... A43B 11/00 36/50.1
2005/0016021 A1 * 1/2005 Marvin ..... A43B 13/14 36/29
2005/0198867 A1 9/2005 Labbe
2007/0209234 A1 * 9/2007 Chou ..... A43B 11/00 36/50.1
2008/0141559 A1 * 6/2008 Marc ..... A43B 13/181 36/27
2011/0131839 A1 * 6/2011 Ballin ..... A43B 13/186 36/141
2011/0146106 A1 * 6/2011 Kaufman ..... A43C 11/00 36/105
2015/0305436 A1 * 10/2015 Doyle ..... A43B 13/203 36/43

* cited by examiner

Fig. 1
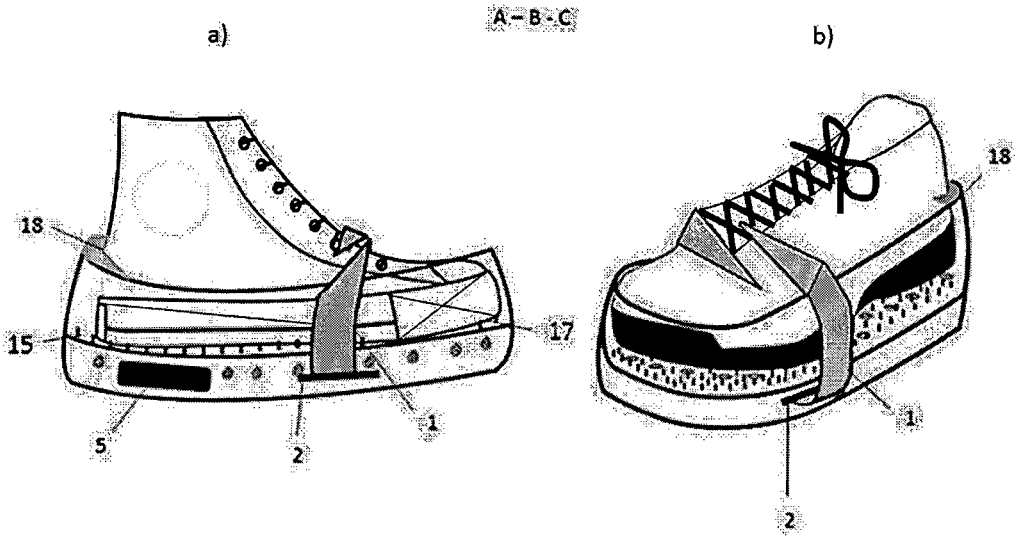
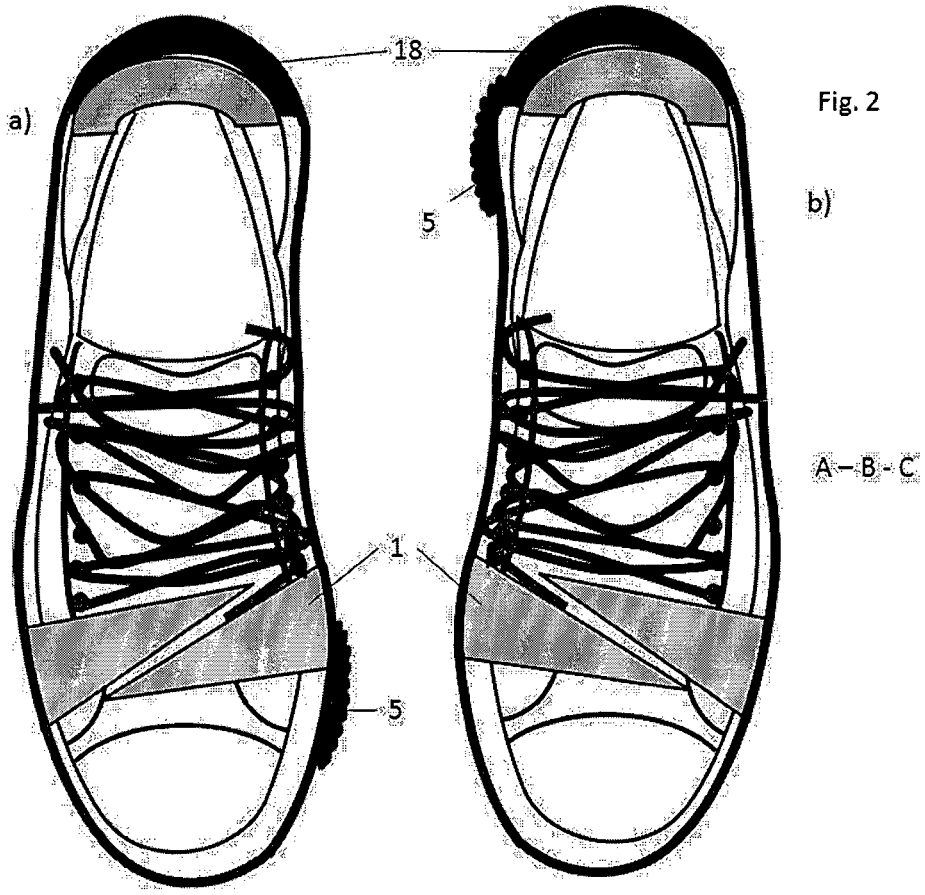
Fig. 2

Fig. 3
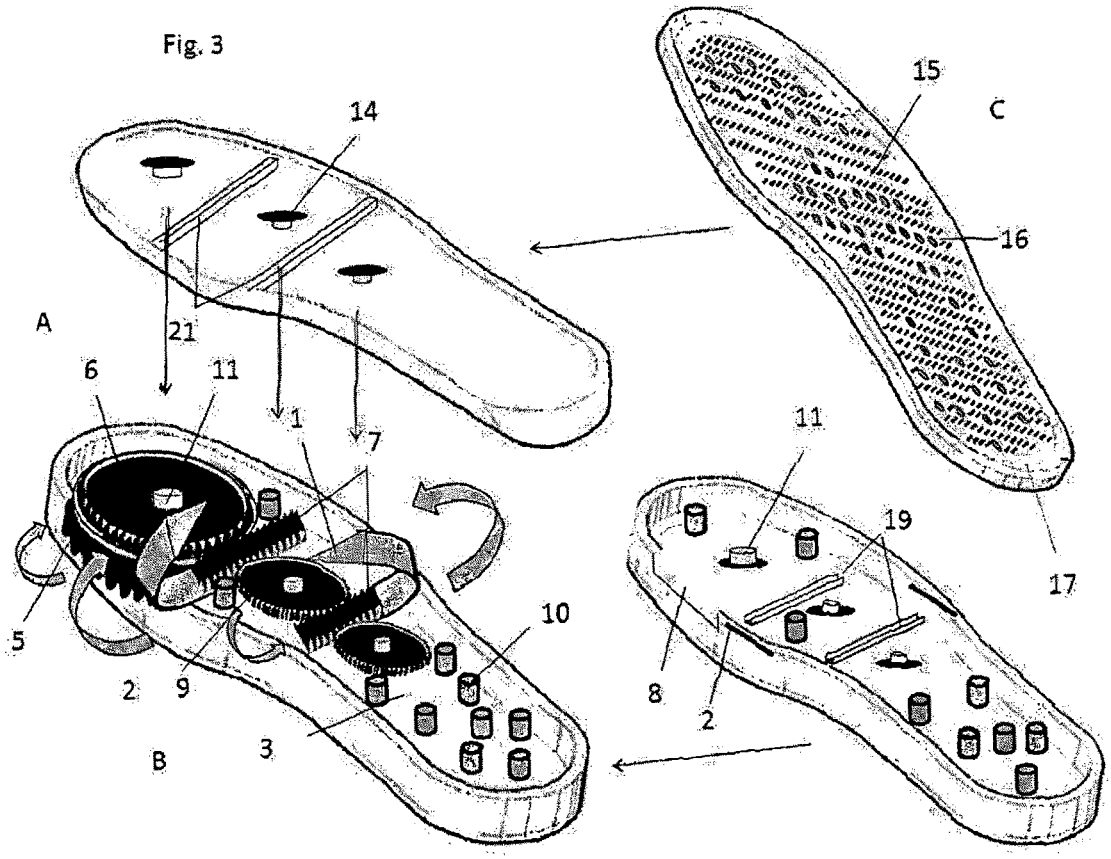
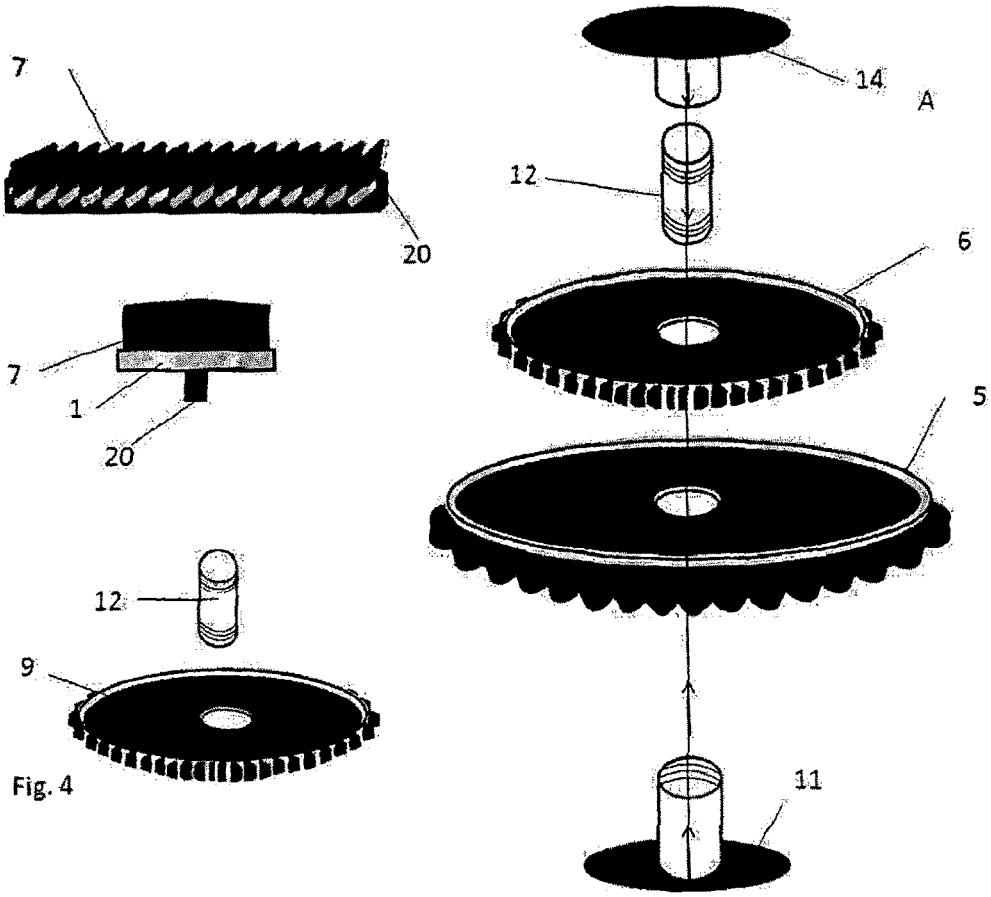
Fig. 4

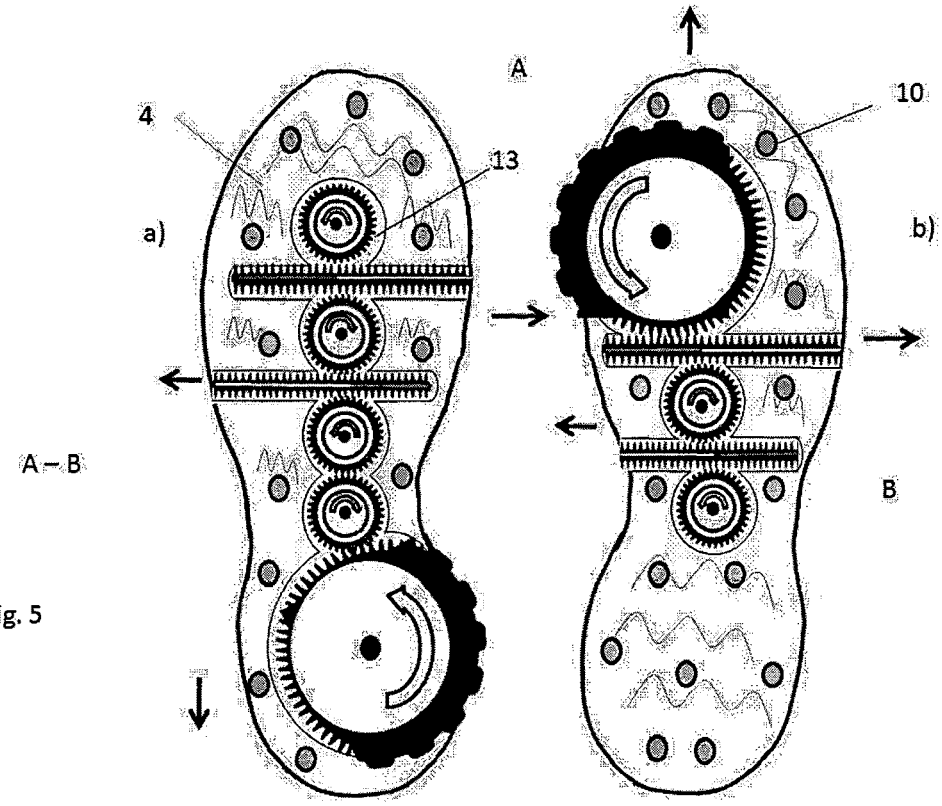
Fig. 5
Fig. 6
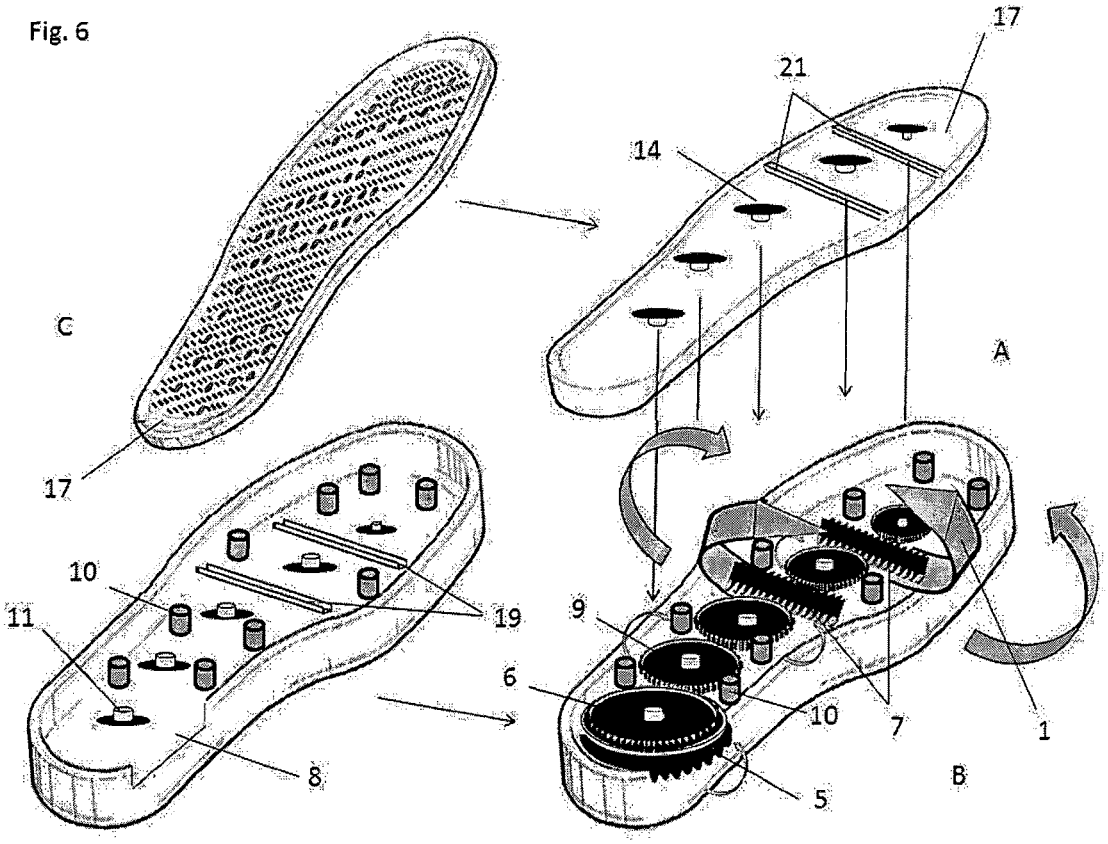

C

A – B

SELF-FASTENING INDOOR PROTECTING DEVICE

The invention named SELF LACING AND INDOOR PROTECTION DEVICE refers to a pair of special footwear, gum shoe type, provided with an automatic mechanism whereby anyone can keep room hygiene if they do not want to get off the shoes they enter from outdoors side or they can protect their footwear of dirty areas by inserting and fastening their own footwear into the SELF LACING AND INDOOR PROTECTION DEVICE without leaning and without using the hands to insert the foot and closing/opening the shoe fastening slings or can fasten their own shoes if the mechanism SELF LACING AND INDOOR PROTECTION DEVICE is applied to the sole of a normal shoe.

The TECHNICAL FIELD OF USE of the invention is both domestic and institutional, and can be used both by private individuals and in institutional establishments such as hospitals, schools, kindergartens, museums or churches. The importance of this device is extremely high, given the fact that, from convenience or by invoking the fact that they "enter just a bit", many people prefer not to get off their shoes at the entrance to a room. More than 400,000 types of bacteria, including *Klebsiella* pneumonia (causing respiratory infections), *Serratia ficaria* (which causes urinary tract infections) and a lot of *E. Coli* type bacteria (leading to kidney infections, including the potentially lethal type) are found on the surface of a shoe sole, according to international studies, their shoe-to-floor transfer being between 90 and 99%. Until now, homeowners or institutions used for hygiene purposes, if they did not condition people to unshoe at the entrance to the premises, several types of plastic or rubber bags or gum shoes type in which they wrapped their shoes when coming from outdoors and the normal footwear was fitted for fastening and tightening on the foot of the leg with eyelets, hedgehog or elastic bands. For older or overweight persons or for children under the age of 6, the process of attaching the footwear to a protective and hygiene footwear or the process of tightening footwear on the foot was very tedious, the effort being considerable, most of them having to ask for the help of others.

Several documents are also known, among which U.S. Pat. Nos. 7,059,069 B2, 8,522,456 B2 or 6,378,230 B1 which relate to various devices and mechanisms of automatic footwear fastening, but they primarily do not refer to premises protection footwear by shoe sole isolation and on the other hand, they require a very complex manufacturing process, containing many elements and subassemblies that reduce the reliability of the product, posing the risk of their failure and more than that, the cost of manufacturing them can lead to a too higher price for most potential customers through the need to use different materials and the variety of moulds required for casting. The document US2005019867 A1 also describes, without referring to premises protection footwear by shoe sole isolation, an automatic shoe closure mechanism, but which also uses defective elements, in addition to the locking/unlocking mechanism which is hardly accessible for people to whom the finished product is addressed, for whom it is difficult to lean or who need help from others (children or people with disabilities). The document U.S. Pat. No. 5,513,599A discloses a mechanism using air to inflate parts of footwear by using an air pump, but which requires the action of a person by means of the hands for both inflating and deflating, difficult action for the persons having hands occupied, or having difficulty in leaning or handling such a system (children or people with disabilities).

The DISADVANTAGES of the current methods for solving this problem are the following:

- The mechanisms and materials used are very complex, requiring high design and manufacturing costs.
- The necessary materials are not water resistant, this deficiency is major, both in the case of normal footwear, but also in the case where the device is used for premises protection and hygiene footwear, when cleaning the shoes of dust or mud is not possible, or is dangerous for its continued operation.
- Reliability of multi-part gears decreases the lifetime of the product, failure of a single part can lead to the entire mechanism being gripped.
- Industrial application requires huge investments, manufacturing companies having to purchase very expensive machinery and lines of production in relation to the potential revenue generated by the final product selling.
- The area of addressability is quite low, limited to individual consumers.
- The applicability in the design of a normal shoe is difficult if not impossible, the final aspect being altered by the insertion of complex elements and mechanisms.
- The protection of the mechanism from water or dust is very difficult, both because of the size and the elements that come out of the footwear shape, making it difficult to capsulate most of the motor elements.
- The way of unclipping the slings of the mentioned mechanisms, when people want to unshoe, is quite tedious, making it hardly desirable by the persons to whom it is addressed.
- The use in high-frequency conditions can result in the failure of these complex and sensitive devices in a very short time.
- The presence of the present invention eliminates the mentioned disadvantages.

The technical problem solved by the invention SELF LACING AND INDOOR PROTECTION DEVICE is keeping room hygiene if a person does not want to get off their shoes they enter indoors from outdoors, or can protect their shoes from dirty areas by inserting and fastening their own footwear in the SELF LACING AND INDOOR PROTECTION DEVICE without leaning and without using hands for inserting the foot and unclipping/clipping the strain of the footwear fastening slings or foot if the SELF LACING AND INDOOR PROTECTION DEVICE's mechanism is applied to the sole of a normal shoe.

The ADVANTAGES of the invention consist of the following:

- Protects in a 100% percent the indoor surfaces if a person wants to enter the premises without getting off their shoes.
- Allows people who have their hands occupied with different goods to put on and get off their shoes without any effort and without having to use their hands and without having to lean.
- The device is very simple and the mechanism is reduced in size, and can be applied to almost any type of shoe.
- Design and manufacturing costs are low.
- The materials used are resistant to water, dust or mud, and even there is the possibility of daily washing the device with a brush and soap under the water jet if this is desired.

The few elements of the device increase the reliability and lifetime of the product, the failure within the warranty period is almost impossible.

Industrial applications require minimal investment, with manufacturing companies investing minimum amounts in manufacturing compared to the potential revenue generated by the final product selling.

The scope of addressability is general, not limited to individual consumers, being one of the only footwear products with very high addressability in the institutional field.

The applicability of the mechanism in the production of normal footwear is easy, the final appearance being not altered by the insertion of the device.

The protection of the mechanism from water or dust is very simple, with the possibility of encapsulation of the drive elements.

The clipping/unclipping of the device and the footwear, if the mechanism is inserted into the sole of a normal shoe, both when people want to shoe and when they want to unshoe is extremely simple, making it immediately enjoyable by all the people who use it.

The use under high frequency conditions does not affect the integrity of the device.

The side surfaces of the device's soles are generous, allowing them to be personalized for prints, according to buyers' preferences.

Here are some examples of design of the invention named "SELF LACING AND INDOOR PROTECTION DEVICE", related to FIGS. 1~18, which represent:

FIG. 1—Side and perspective view of the SELF LACING AND INDOOR PROTECTION DEVICE—protecting premises by inserting and fixing the footwear inside it.

FIG. 2—Top view of the SELF LACING AND INDOOR PROTECTION DEVICE—protecting premises by inserting and fixing the footwear inside it.

FIG. 3—Perspective view of Subassemblies A, B and C belonging to the mechanism.

FIG. 4—Perspective view of drive and fixed elements that are part of the Subassembly A, which ensures the operation of the SELF LACING AND INDOOR PROTECTION DEVICE.

FIG. 5—Top view of the Subassemblies A and B belonging to the SELF LACING AND INDOOR PROTECTION DEVICE.

FIG. 6—Top view of the Subassemblies A, B and C belonging to the SELF LACING AND INDOOR PROTECTION DEVICE.

FIG. 7—Perspective view of the Subassembly C.

Figure 8:
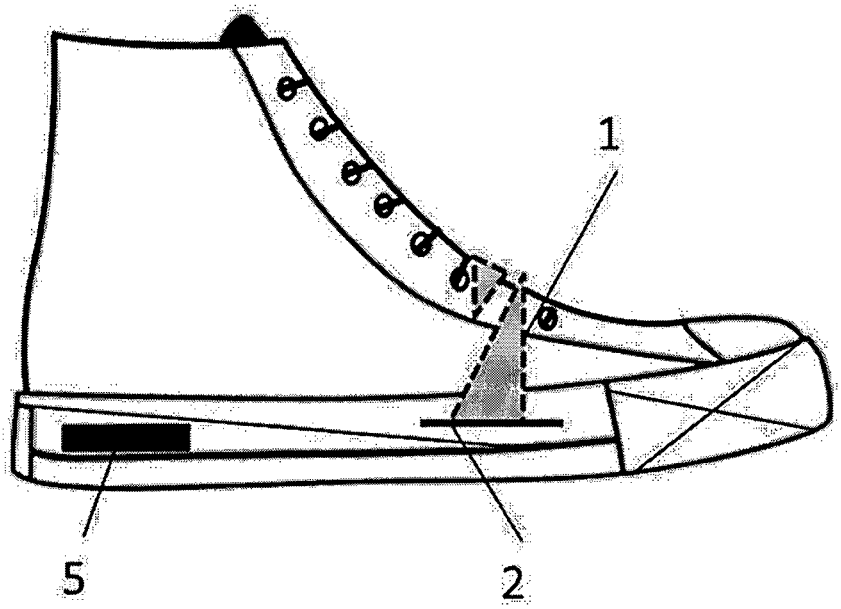

FIG. 8—View from a lateral position of how the SELF LACING AND INDOOR PROTECTION DEVICE "is inserted into the sole of a normal footwear for daily outdoors wearing, the method by which the person can shoe or unshoe the footwear without leaning or using the hands to clip/unclip a shoe.

Figure 9:
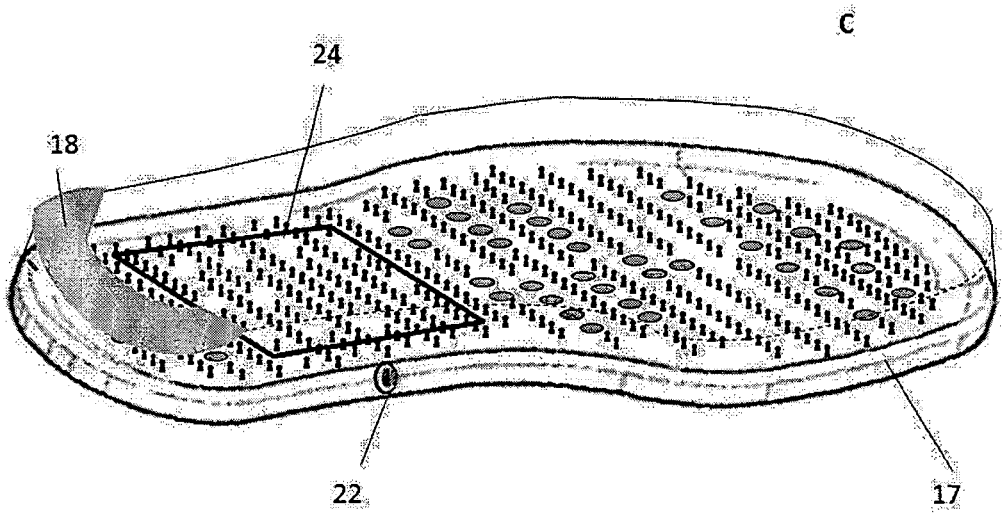

FIG. 9—Perspective view of the Subassembly C of the "SELF LACING AND INDOOR PROTECTION DEVICE in another constructive shape.

Figure 10:
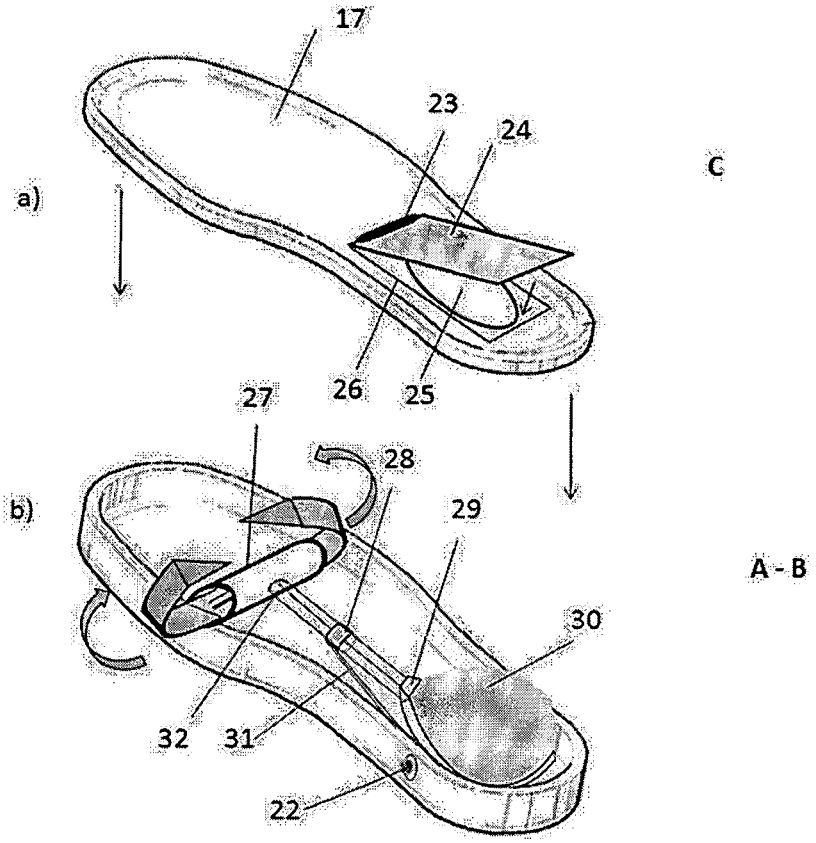

FIG. 10—*a*), *b*) Perspective view of the Subassemblies A, B and C of the SELF LACING AND INDOOR PROTECTION DEVICE, in another constructive shape.

Figure 11:
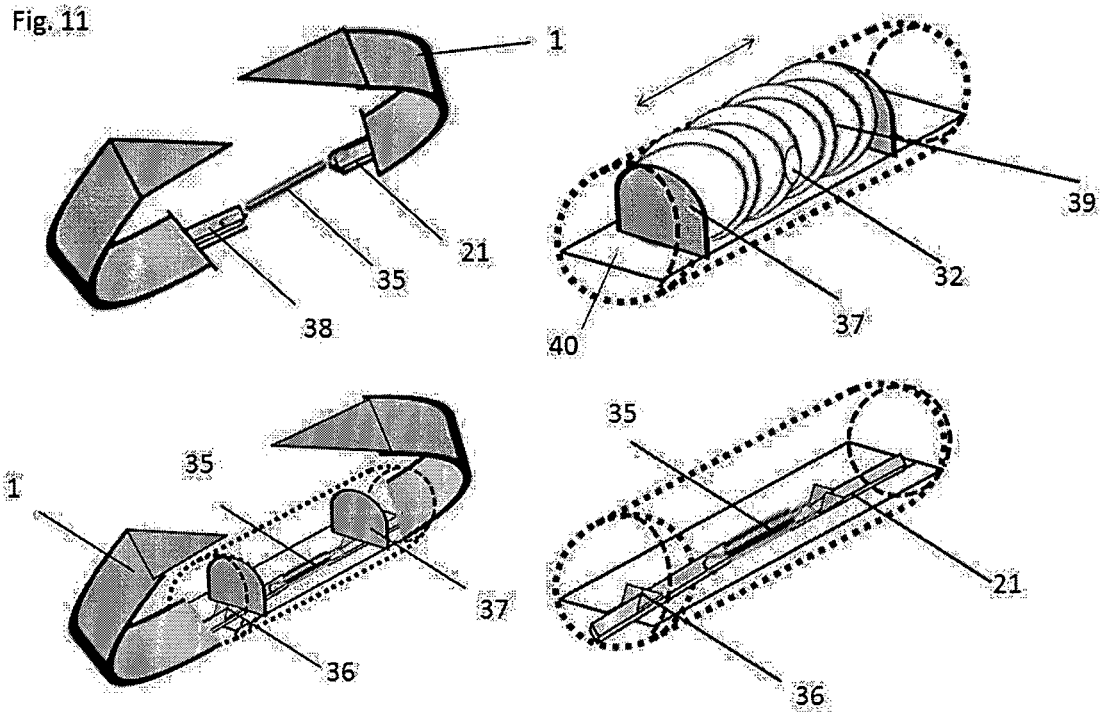

FIG. 11—Perspective view of drive elements belonging to the Subassembly A of the SELF LACING AND INDOOR PROTECTION DEVICE in another constructive shape.

Figure 12:
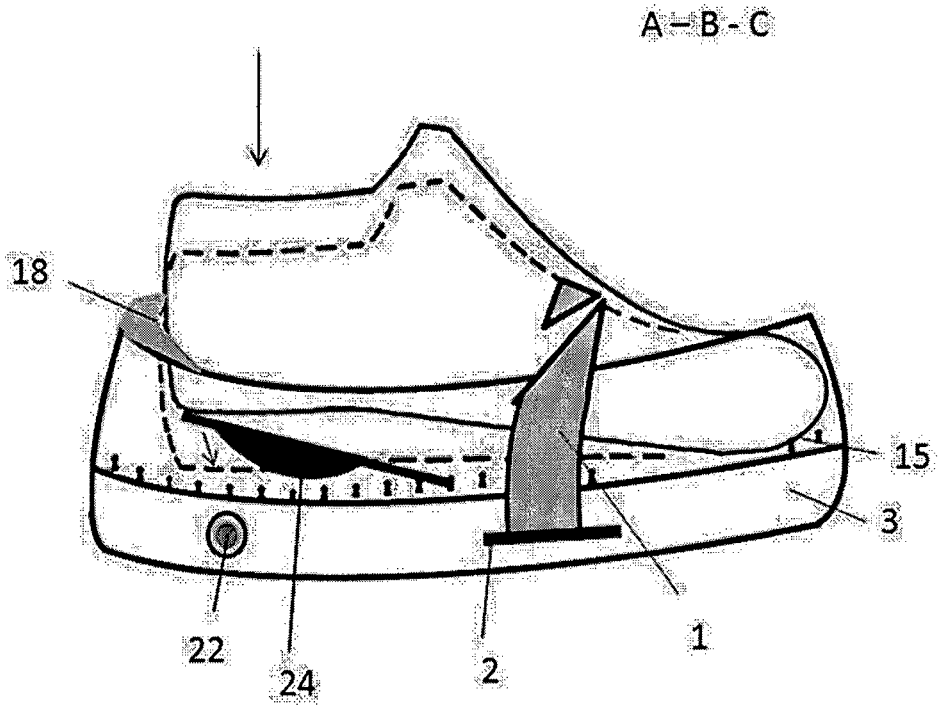

FIG. 12—Side view of the SELF LACING AND INDOOR PROTECTION DEVICE—protecting premises by inserting and fixing the footwear inside it, in another constructive shape.

Figure 13:
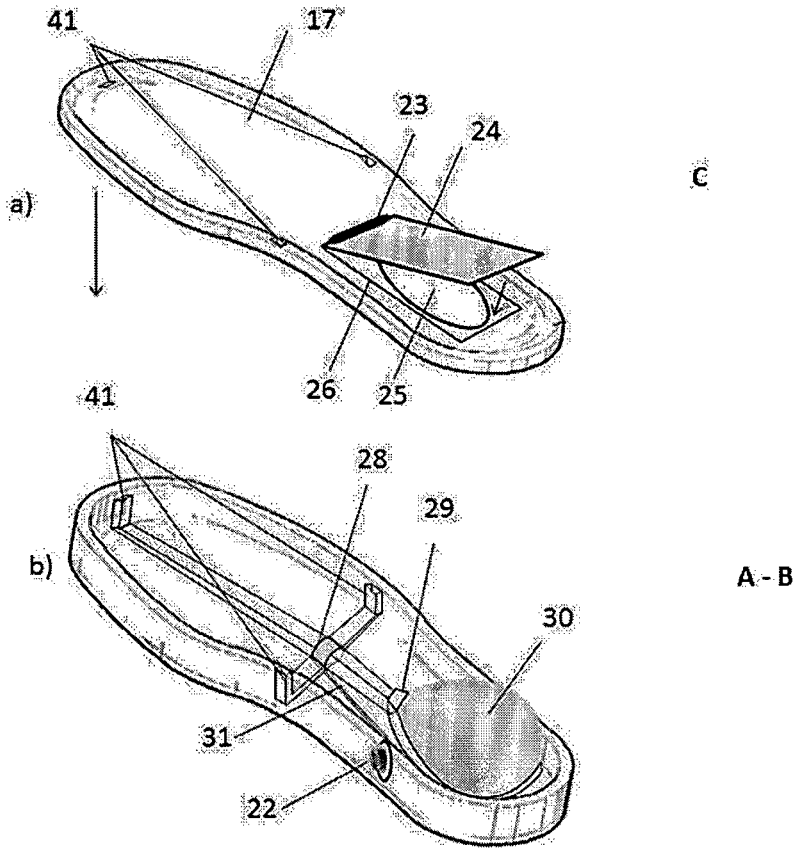

FIG. 13—*a*), *b*) Perspective view of the Subassemblies A, B and C of the SELF LACING AND INDOOR PROTECTION DEVICE, in another constructive shape.

Figure 14:
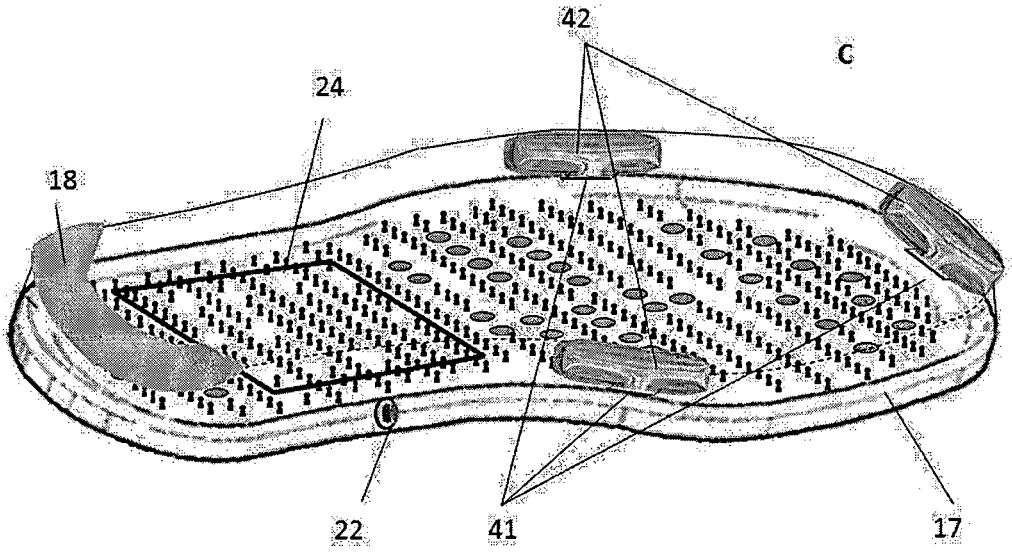

FIG. 14-FIG. 10—Perspective view of the Subassembly C of the SELF LACING AND INDOOR PROTECTION DEVICE, in another constructive shape.

Figure 15:
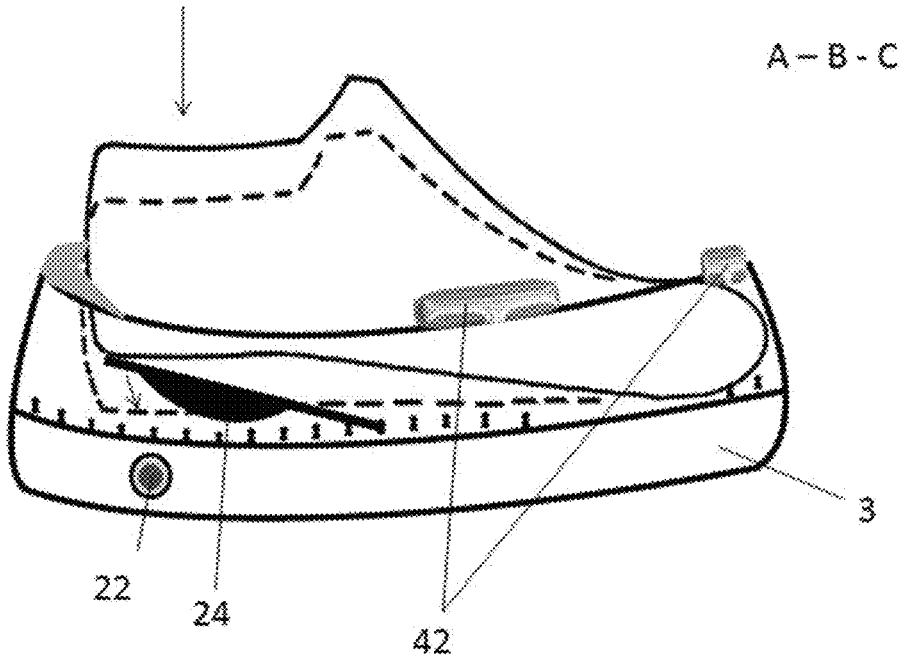

FIG. 15—Side view of the SELF LACING AND INDOOR PROTECTION DEVICE—protecting premises by inserting and fixing the footwear inside it, in another constructive shape.

Figure 16:
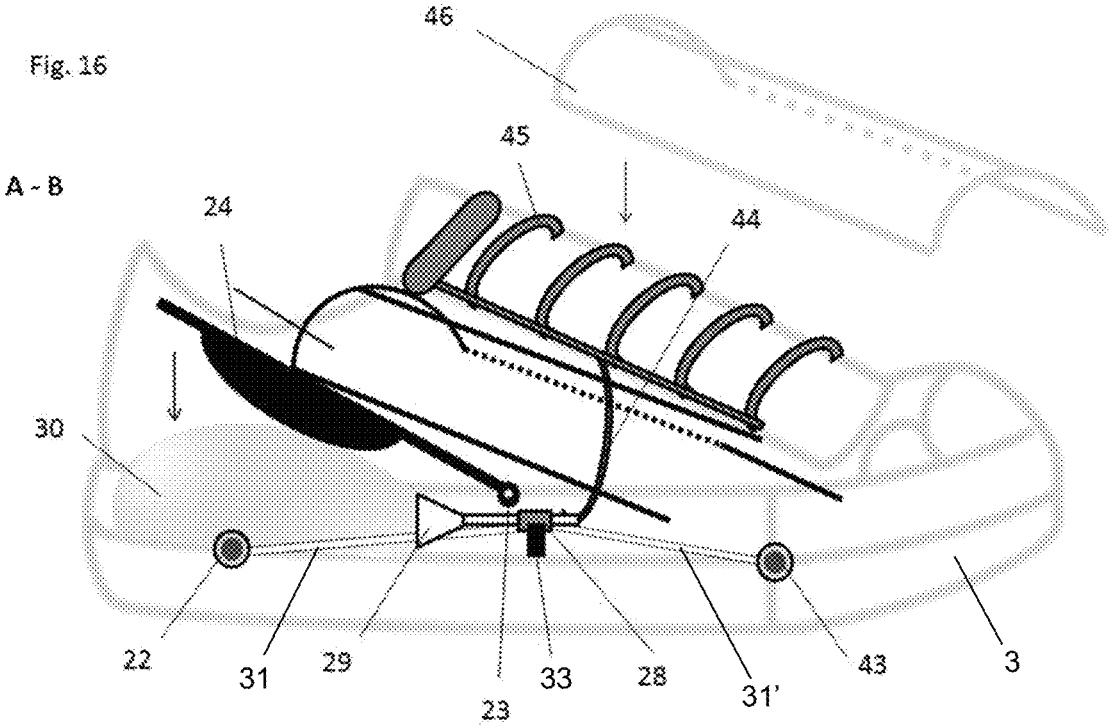

FIG. 16—Open position of the SELF LACING AND INDOOR PROTECTION DEVICE—Side view of the way in which the SELF LACING AND INDOOR PROTECTION DEVICE may be used in the direction in which the Subassemblies A and B of the SELF LACING AND INDOOR PROTECTION DEVICE are inserted into the sole of a normal footwear for daily outdoors wearing, the method by which the person can shoe or unshoe the footwear without leaning or using the hands to clip/unclip a shoe sling.

Figure 17:
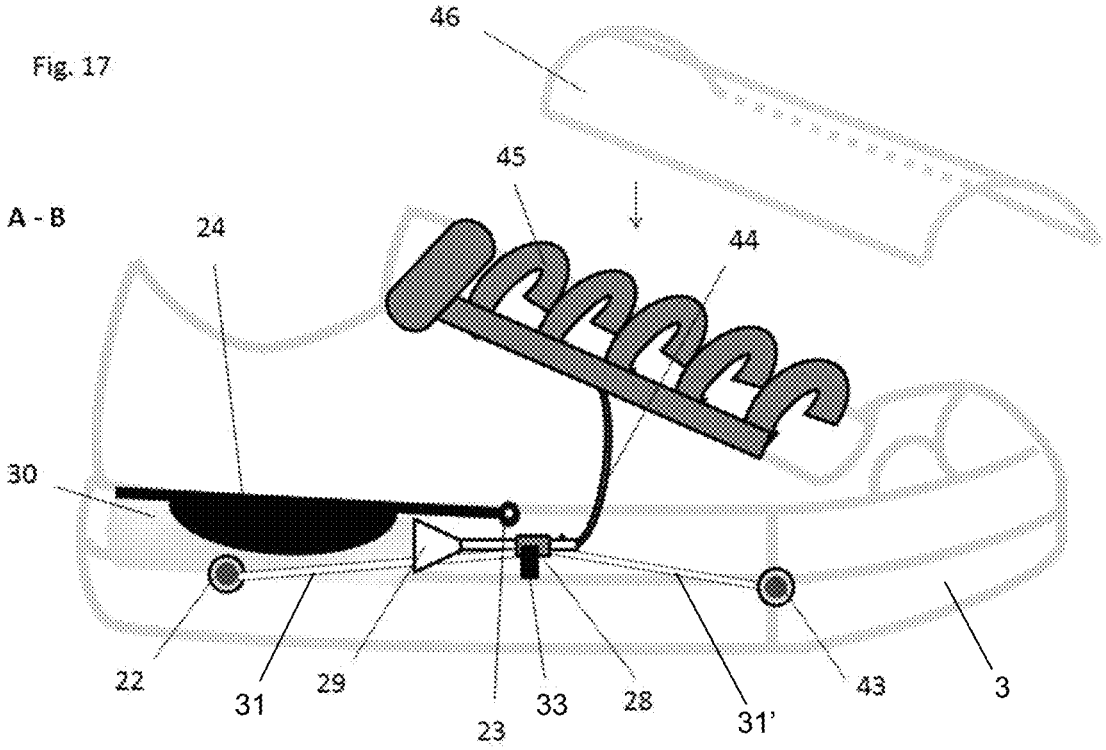

FIG. 17—Open position of the SELF LACING AND INDOOR PROTECTION DEVICE—Side view of the way in which the SELF LACING AND INDOOR PROTECTION DEVICE may be used in the direction in which the Subassemblies A and B of the SELF LACING AND INDOOR PROTECTION DEVICE are inserted into the sole of a normal footwear for daily outdoors wearing, the method by which the person can shoe or unshoe the footwear without leaning or using the hands to clip/unclip a shoe, in another constructive shape.

Figure 18:
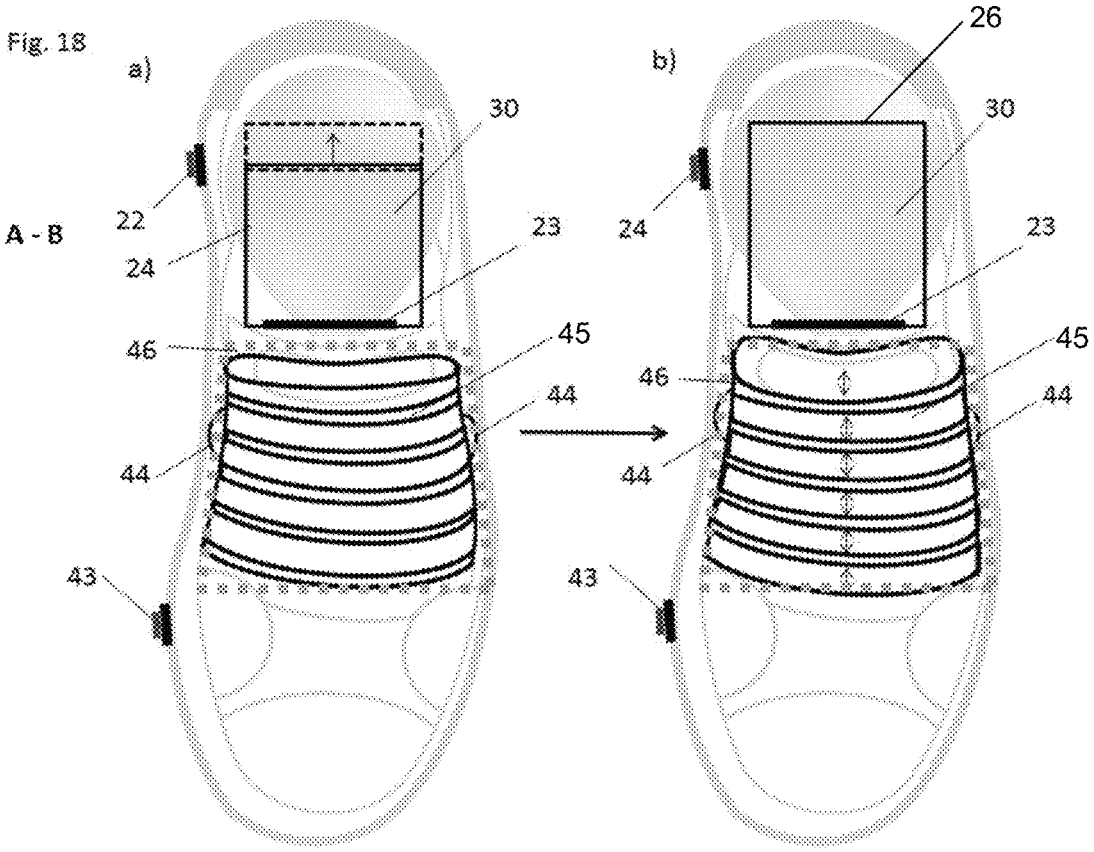

FIG. 18 *a*), *b*) Open/closed position of the SELF LACING AND INDOOR PROTECTION DEVICE—Top view of the way in which the SELF LACING AND INDOOR PROTECTION DEVICE may be used in the direction in which the Subassemblies A and B of the SELF LACING AND INDOOR PROTECTION DEVICE are inserted into the sole of a normal footwear for daily outdoors wearing, the method by which the person can shoe or unshoe the footwear without leaning or using the hands to clip/unclip a shoe, in another constructive shape.

Basically, the SELF LACING AND INDOOR PROTECTION DEVICE, according to the invention, is a device consisting of two lower and upper brackets, operated by a relatively simple mechanism, formed in a first constructive shape of a toothed wheel assembly, which conveys the gearshift movement from the steering wheel to the wheels and then to the gear racks for the shoe fastening slings. In another constructive shape, the device can be operated by a person by heel, both without leaning and without using their hands, by directing the air in an inflatable tank by a pneumatic mechanism to the sliding slings or to an inflatable sling system. The SELF LACING AND INDOOR PROTECTION DEVICE can be used in two ways. In the first way, the SELF LACING AND INDOOR PROTECTION DEVICE is especially used to insert and fix in it the footwear which the person is wearing when wanting to get indoors from outside the premises without getting off their shoes, while protecting the premises from the bacteria on the sole of the shoes with which they came from outdoors. In the second way, the mechanism SELF LACING AND INDOOR PROTECTION DEVICE can be inserted into the sole of a daily footwear, in which case people can benefit from an automatic shoe attachment on the foot. The SELF LACING AND INDOOR PROTECTION DEVICE previously named can be easily manipulated by any person regardless of age, both without leaning and without using their hands. The SELF LACING AND INDOOR PROTECTION DEVICE is composed of the following main parts:

1.—Subassembly A—a mechanical drive device formed, in a first constructive shape, from a toothed wheel gear which simultaneously conveys the movement imparted by the control wheel to the gear racks of the shoe fastening slings by means of the operation by a person by moving forwards and backwards one of the shoes, stacked to the side of the other; or, in another constructive shape, from a pneumatic system that directs air in an inflatable tank to a system of sliding or inflatable shoe fastening slings, in another constructive shape.

2.—Subassembly B—mounting and ground contact device represents the sole and the lower mounting frame of the Subassembly A in any constructive shape, also having the role of tank for the water drained from the shoes worn outdoors.

3.—Subassembly C—a device for mounting and actuating the device in any constructive shape, represents the upper mounting frame of the Subassembly A but also for sealing it, as well as the contact surface and the fixing surface of the footwear (high-grade insole), but also for capturing and directing the water through the drain holes on the surface of its sole in the tank inside the Subassembly B.

4.—Subassembly D—a cylindrical pneumatic device for driving the sliding slings or blowing the inflatable slings by inflating/deflating an inflatable cylinder, driven by the transfer of air from the inflatable tank, in a certain constructive shape.

Subassembly (A), the main mechanical device, is formed by a closing/opening control wheel (5) for operating the entire device on the upper surface in which a toothed wheel (6) is mounted, which engages the first toothed wheel of a succession of toothed wheels (9) acting simultaneously by sliding by guiding rails (19) the gear racks (7) which support the sliding slings (1) for fastening/releasing the footwear inserted through the guiding slots (2). In another constructive shape, the Subassembly (A) consists of the Subassembly (D) which ensures the fastening by transferring air through the transport manifold (29) through the one-way valve (28) by compressing the driving surface of a flap (24) through the flexible supply manifold (44) to the shoe fastening cushions (42) or to the inflatable slings (45) compressed for inflation towards the inside of the shoe against the compression surface (46), and for relaxing the shoe strain by deflating the slings (45) by pressing the external button (22) which fully or partially opens the valve (28) by pressing the button (43) for dosing the shoe strain by exhausting the air from inside to the outside of the air circuit which can be inflated again with air using the filling valve (33).

Subassembly (B), secondary support and mounting device fixes the shoe by means of the flexible shoe hitch for positioning the footwear and forms the ground contact soleplate-type device (3) and the lower frame of the water tank and the device for mounting the Subassembly (A) parts by first inserting and fastening the concentric threaded cylinders (12) into the concentric holes of the control and drive teethed wheels (5), (6) and (9) and subsequently in the lower fixed axles (11), and for the shoe support located on the surface of the Subassembly (C) it is provided with a plurality of rigid support points (10)

Subassembly C, secondary support and mounting device is the lid and insole type device for positioning the shoe and upper/sealing mounting of the Subassembly (A) parts by inserting and fastening the concentric threaded cylinders (12) firstly into the concentric holes of the toothed wheels and the control and drive wheels (5), (6), and (9) and then in the fixed upper axles (14) being formed by a surface of contact with the shoe sole and a mounting surface (17) on the upper surface on which the upper brackets (21) are provided for gear racks and more rubber boots (15) for fastening the footwear, and for providing water drainage out of the shoe surface inside the water and waste tank (4) formed by sealing the Subassembly (B) to the Subassembly (C), it is provided with several holes (16) with filtering sieve to block drainage of bulky residues;

Subassembly D, a pneumatic device which is formed by a mounting cylindrical housing (27) fixed to the Subassembly (C) surface comprising the guiding slots (19) on the surface of which slings (1) are sliding horizontally by means of the arms (38) driven by removing/nearing the pads (37) sliding on the surface of the bracket (40) through the sliding rails (34) by means of the guiding slots (36) by inflating/deflating the inflatable cylinder (39) through the hole (32) which is compressed to open the slings by means of a spring (35).

The SELF LACING AND INDOOR PROTECTION DEVICE can be easily used by people of all ages both for the protection of the premises by the bacteria on the footwear sole by inserting it into the footwear holders and for the automatic fastening of the daily footwear without the need to lean for persons to shoe/unshoe or tie the shoelaces or other types of shoe sling types.

This invention can be applied industrially by manufacturing a large number of SELF LACING AND INDOOR PROTECTION DEVICE, both for the manufacture of footwear for the protection of the premises by the bacteria on the footwear sole, and for the application of the device to the daily footwear.

The List of Positions with the Names of the Items in the Drawings:

Pos. 1—Sliding sling to clip the footwear.

Pos. 2—Sliding rail for the passage and guiding of the shoe fastening sling.

Pos. 3—Rubber body of the bracket of the automatic shoe fastening device.

Pos. 4—Tanks for drainage of liquid residues from the shoe surface.

Pos. 5—Closing/opening control wheel of the automatic shoe fastening device.

Pos. 6—Toothed wheel attached to the closing/opening control wheel of the automatic shoe fastening device.

Pos. 7—Gear rack type slider for pushing/pulling the sliding sling for attaching/fastening the shoe.

Pos. 8—Sliding rail for the passage and guiding of the closing/opening control wheel of the automatic shoe fastening device.

Pos. 9—Toothed wheels for driving the other wheels or the second gear rack for pushing the second shoe attaching/fastening sling.

Pos. 10—Insole-type lid support point of the automatic shoe fastening device.

Pos. 11—Lower fixed threaded cylinder, for screwing the teethed wheels of the automatic shoe fastening device.

Pos. 12—Concentric threaded cylinder, for fixing and screwing the teethed wheels of the automatic shoe fastening device.

Pos. 13—Insulating/guiding/fixing area on the sole of the automatic shoe fastening device.

Pos. 14—Upper fixed cylinder, with conical thread, for screwing the teethed wheels of the automatic shoe fastening device.

Pos. 15—Rubber boots for shoe attachment when positioned in the bracket of the automatic shoe fastening device.

Pos. 16—Drill holes in the bracket of the automatic shoe fastening device for drainage of dirty water on the sole of the shoe.

Pos. 17—Lid sole of the automatic shoe fastening device.

Pos. 18—Flexible hitch for positioning and fastening the footwear into the bracket of the automatic shoe fastening device.

Pos. 19—Horizontal sliding rail of gear racks.

Pos. 20—Guiding rail for fixing gear racks in the sliding rails.

Pos. 21—Upper gear rack bracket.

Pos. 22—External button for full opening of the one-way valve.

Pos. 23 Swinging hinge of the flap having a compression driving surface for the inflatable tank.

Pos. 24 Flap having a compression driving surface for the inflatable tank.

Pos. 25—Expansion hole of the inflatable tank.

Pos. 26—Fastening frame of the driving surface of the inflatable tank.

Pos. 27—Mounting housing for the sling pneumatic drive mechanism.

Pos. 28—One-way air valve.

Pos. 29—Air transport manifold from the inflatable tank to the device drive circuit.

Pos. 30—Inflatable air tank.

Pos. 31—One-way valve opening lever for return of air from the drive circuit to the inflatable tank.

Pos. 32—Coupling of the air transport manifold for inflation/deflation of the inflatable cylinder of sliding slings.

Pos. 33—Air circuit supply valve.

Pos. 34—Sliding slots of contact pads with the inflatable cylinder.

Pos. 35—Spring for straining and compression of the inflatable cylinder.

Pos. 36—Sliding guides for contact pads.

Pos. 37—Inflatable cylinder contact pads.

Pos. 38—Sliding sling drive arms.

Pos. 39—Inflatable cylinder.

Pos. 40—Inflatable cylinder bracket.

Pos. 41—Air circuit holes connecting with inflatable cushions for shoe fastening.

Pos. 42—Inflatable cushions for shoe fastening in the device.

Pos. 43—External controlled opening button for one-way valve for controlled circuit air discharge.

Pos. 44—Flexible air supply manifold for inflatable slings.

Pos. 45—Inflatable slings for fastening the foot in the shoes.

Pos. 46—Compression surface of the inflatable slings for exhausting the air from them to the air tank.

The invention claimed is:

1. A multifunctional subassembly for footwear, the subassembly comprising:

an inflatable air tank (30) configured to be arranged on an upper surface of a sole of a footwear, at a heel side of the sole, a plurality of inflatable elements (45) compressible by inflation toward an inside of the footwear, against a compression surface (46) of the footwear, a first manifold (29) connected to the inflatable air tank (30), and also connected through a valve (28) to a second manifold (44), the second manifold (44) being connected to an capable of supplying air to the plurality of inflatable elements (45), a flap (24) having a compression driving surface in contact with and configured to press the inflatable air tank (30), the flap (24) being hinged by means of a hinge (23) to a frame (26) configured to be arranged inside the footwear, and a first button (22) which, when pressed, fully or partially opens the valve (28).

2. The subassembly of claim 1, wherein:

the plurality of inflatable elements comprises a plurality of inflatable slings (45), wherein the plurality of inflatable slings (45) are configured to be arranged on the footwear in an area corresponding to an upper zone of the foot, and configured to follow the shape of the area corresponding to the upper zone of the foot, and the inflatable air tank (30), the first manifold (29), the second manifold (44) and the inflatable slings (45) define an air circuit, the subassembly comprises a second button (43) which, when pressed, is capable of relaxing a shoe strain by exhausting air from the air circuit to the outside, and the subassembly comprises a filling valve (33) through which the air circuit can be inflated with air.

* * * * *